US006808242B2

(12) United States Patent
Kobayashi

(10) Patent No.: US 6,808,242 B2
(45) Date of Patent: Oct. 26, 2004

(54) PRINT HEAD DRIVE UNIT

(75) Inventor: Isao Kobayashi, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 58 days.

(21) Appl. No.: 10/331,022

(22) Filed: Dec. 27, 2002

(65) Prior Publication Data

US 2003/0122885 A1 Jul. 3, 2003

(30) Foreign Application Priority Data

Dec. 28, 2001 (JP) ..... P2001-400311

(51) Int. Cl.[7] ..... B41J 29/38
(52) U.S. Cl. ..... 347/12; 347/14
(58) Field of Search ..... 347/9, 12–14

(56) References Cited

U.S. PATENT DOCUMENTS 5,359,352 A * 10/1994 Saita et al. ..... 347/62

FOREIGN PATENT DOCUMENTS

| | | |
|---|---|---|
| JP | 9262974 | 10/1997 |
| JP | 9262978 | 10/1997 |
| JP | 9272200 | 10/1997 |

* cited by examiner

*Primary Examiner*—Michael S. Brooke
(74) *Attorney, Agent, or Firm*—Reed Smith LLP

(57) ABSTRACT

A drive unit is used for independently driving at least two different sections of a print head unit and includes a memory, a print timing judge unit, a comparator, and a print operation delay unit. The memory stores timing maps that indicate rising edges of drive waveforms used to drive the print head unit. The print timing judge unit judges when a particualr one of the sections of the print head unit is to be driven to perform a print operation. If the print timing judge unit judges that the particualr section is to be driven, the comparator searches the timing maps in the memory to find rising edges that overlap between waveforms to be applied to particualr section and other sections of the print head unit. When the comparator finds rising edges that overlap, the print operation delay unit delays drive of the one section until the comparator no longer finds rising edges that overlap while the comparator delays the timing map that corresponds to the particluar section of the print head.

18 Claims, 8 Drawing Sheets

PRINT HEAD DRIVE UNIT

BACKGROUND OF THE INVENTION

1. Field of the Invention

The present invention relates to a print head drive unit used in an ink jet or other type of printer.

2. Description of the Related Art

FIG. 1 shows a conventional ink jet head 100 used in an ink jet printer to eject ink droplets. The ink jet head 100 includes a chamber block 103 and a piezoelectric element 122. The chamber block 103 is formed with a pressure chamber 116, a manifold 124, and an ejection nozzle 120. The pressure chamber 116 is filled with ink. The piezoelectric element 122 is fixed on the upper wall of the chamber block 103 and is connected to a drive circuit 110. To eject ink droplets 126 from the ejection nozzle 120, the drive circuit 110 applies a voltage pulse to the piezoelectric element 122 so that the piezoelectric element 122 deforms. The upper wall of the chamber block 103 deforms accordingly as indicated by dotted line in FIG. 1. When the upper wall of the chamber block 103 deforms into the pressure chamber 116 in this manner, the pressure in the pressure chamber 116 increases and pushes ink out from the pressure chamber 116 and the nozzle 120 in the form of ink droplets 126.

As shown in FIG. 2, an actual ink ejection head 101 includes a plurality of pressure chambers 116 and nozzles 120. Piezoelectric elements 122 are provided on confronting walls that form the pressure chambers 116. The pressure chambers 116 and the nozzles 120 are aligned in an auxiliary scan direction in which recording sheets are transported past the ink ejection head 101. Printing is performed by applying drive voltage pulses selectively to the piezoelectric elements 122 while the print head 101 is being transported in a main scan direction, which is perpendicular to the auxiliary scan direction of sheet transport.

In order to increase print speed, some printers use print heads 101 with an increased number of ejection nozzles 120. Some printers use more than one print head 101 aligned in an array. In order to improve quality of printed images, some printers use a greater number of print heads 101 to enable printing using different colored inks.

Because conventional ink jet printers can have such a large number of ejection nozzles 120 and heads, the chance that the piezoelectric elements 122 of different ejection nozzles 120 will be applied with drive voltage simultaneously is quite high. If drive voltage is applied simultaneously to different piezoelectric elements 122 in this way, the flow of drive current to the different piezoelectric elements 122 will peak at the same time, so that drive voltage drops. The drop in voltage degrades ejection characteristics, such as speed at which the ink droplets 126 are ejected from the nozzles 120, resulting in inferior image quality.

To prevent such a drop in drive voltage, Japanese Patent Application Publication Nos. 9-262974, 9-262978, and 9-272200 disclose shifting current peaks beforehand by a predetermined duration of time in an attempt to prevent current peaks from overlapping.

SUMMARY OF THE INVENTION

However, this conventional method is insufficient for situations when a great variety of different and complicated waveforms are used. For example, recently ink-jet printers have been developed that are capable of gradation printing, that is, capable of printing in a variety of different tones.

Such printers use a variety of different waveforms. Each waveform includes a plurality of drive voltage pulses, and each pulse includes a rising edge and a lowering edge. The plural drive voltage pulses in the waveforms are for ejecting a plurality of ink droplets at the same time or canceling out residual pressure waves after ink ejection. When the waveforms are merely shifted by a predetermined duration of time as in the conventional method, there may be times when the current peaks overlap because of the large number of, and complicated nature of, the waveforms.

To overcome this problem, it is conceivable to modify the shape of the drive waveforms themselves so that the rising and lowering edges of the drive waveforms do not overlap. However, this would influence the size of ejected ink droplets and optimum printing speed so that quality printing cannot be achieved.

It is an objective of the present invention to overcome the above-described problems and to provide a drive unit that is capable of reliably preventing overlap in high current times of different heads or different sections of the same head.

In order to achieve the above-described objectives, a drive unit according to one aspect of the present invention is for driving a print head unit including a plurality of actuators, wherein the drive unit includes a drive circuit, a memory, and a drive circuit control unit. The drive circuit selectively applies drive waveforms of a plurality of drive waveforms to the actuators of the print head unit to drive the actuators. The memory is prestored with a high current time for each of the plurality of drive waveforms. Each high current time represents a time of high current flow resulting from the drive circuit applying the corresponding drive waveform to the actuators. Based on the high current times stored in the memory, the drive circuit control unit controls the drive circuit to apply drive waveforms to different sections of the print head unit at timings with no overlap in high current times of the drive waveforms applied to the different sections.

According to another aspect of the present invention, a drive unit is used for independently driving at least two different sections of a print head unit and includes a memory, a print timing judge unit, a comparator, and a print operation delay unit. The memory stores timing maps that indicate rising edges of drive waveforms used to drive the print head unit. The print timing judge unit judges then one of the sections of the print head unit is to be driven to perform a print operation. If the print timing judge unit judges that the one section is to be driven, the comparator compares the timing maps in the memory to find rising edges that overlap between a timing map that corresponds to a drive waveform used to drive the one section and a timing map that corresponds to a drive waveform used to drive another section of the print head unit. When the comparator finds rising edges that overlap, the print operation delay unit delays drive of the one section until the comparator no longer finds rising edges that overlap after the comparator shifts, according to the delay, the timing map that corresponds to the drive waveform used to drive the one section.

A method according to the present invention is for independently driving at least two different sections of a print head unit. The method includes the steps of judging when one of the sections of the print head unit is to be driven to perform a print operation; comparing, when the one section is to be driven, timing maps that indicate rising edges of drive waveforms used for driving the print head unit; and delaying, when rising edges are found to overlap between a timing map that corresponds to a drive waveform used to drive the one section and a timing map that corresponds to a drive waveform used to drive another section of the print head unit, drive of the one section while shifting, according to the delay, the timing map that corresponds to the drive waveform used to drive the one section until no rising edges are found to overlap.

BRIEF DESCRIPTION OF THE DRAWINGS

The above and other objects, features and advantages of the invention will become more apparent from reading the following description of the embodiment taken in connection with the accompanying drawings in which.

DETAILED DESCRIPTION OF THE EMBODIMENT

Next, a print head drive unit 1 according to an embodiment of the present invention will be described with reference to FIGS. 3 to 10.

Figure 1:
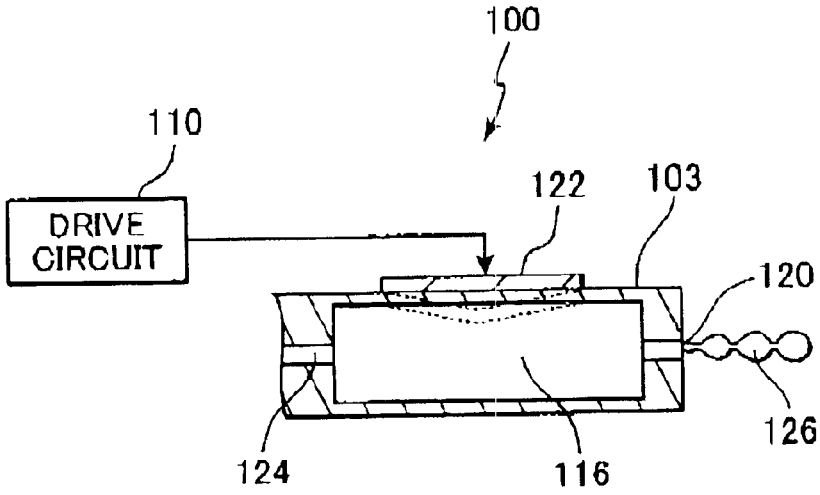
FIG. 1 is a cross-sectional view showing a conventional ink ejection head.
Figure 2:
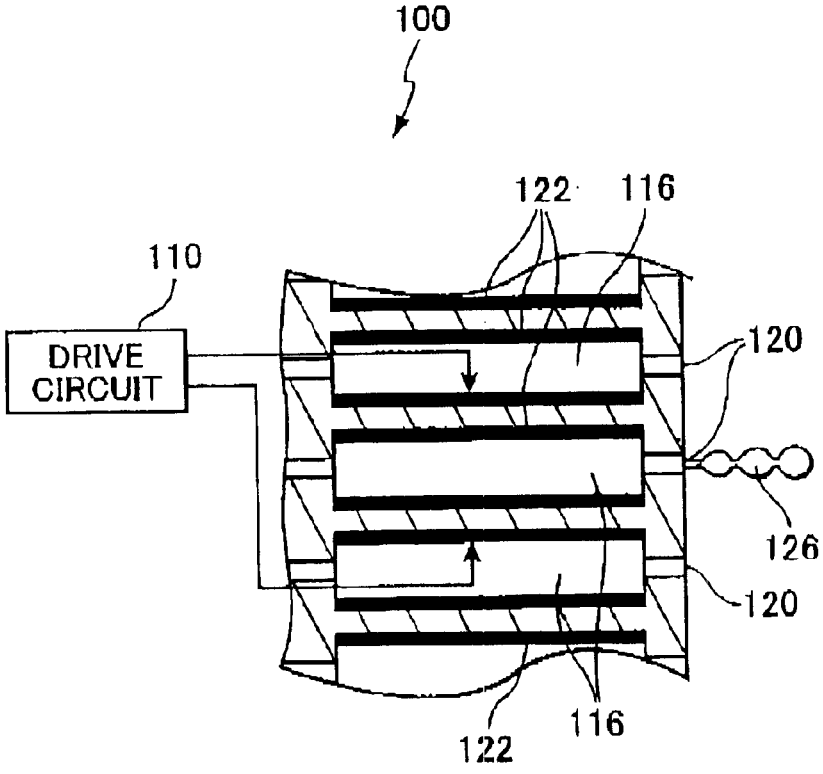
FIG. 2 is a cross-sectional view showing another conventional ink ejection head.
Figure 3:
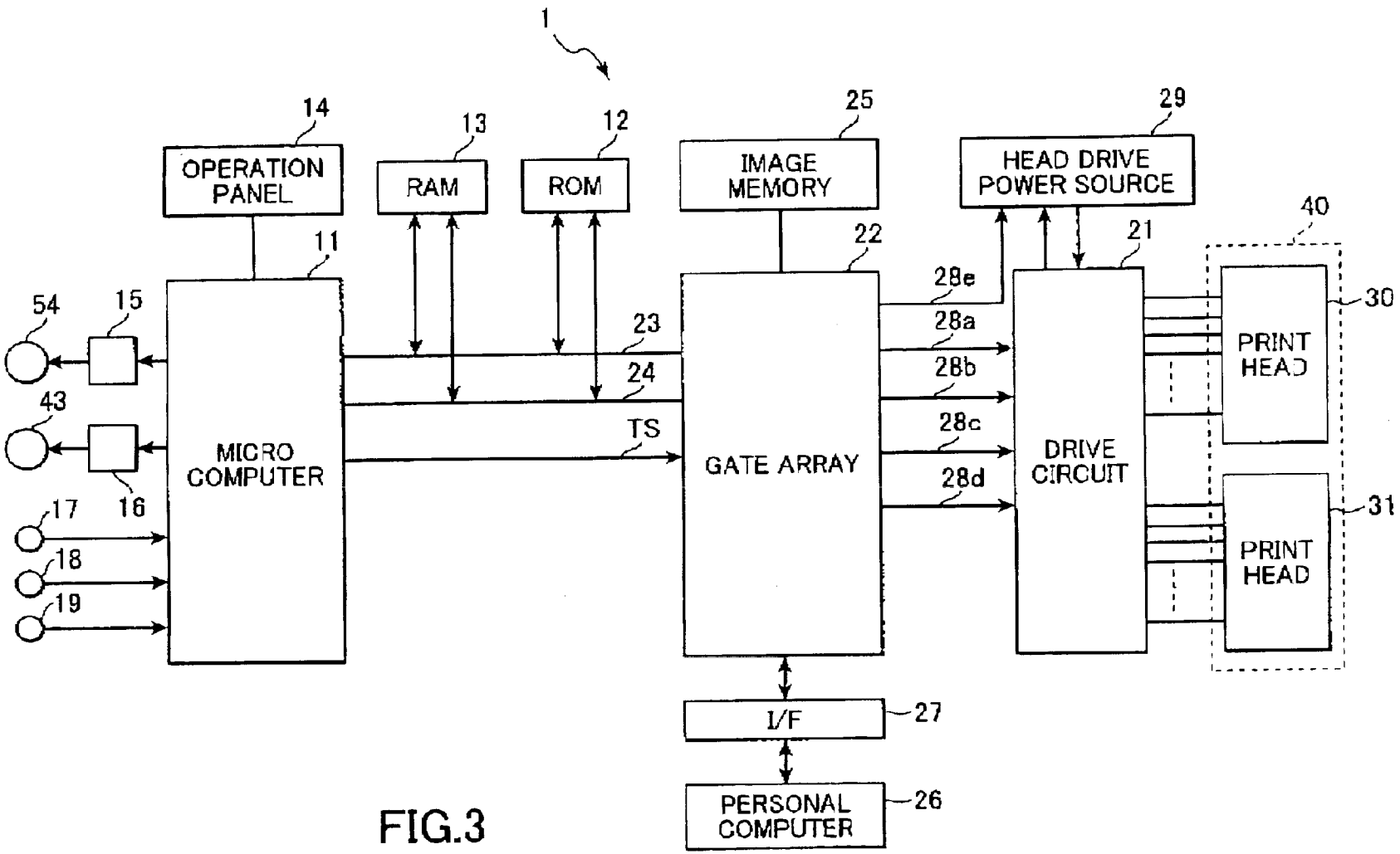
FIG. 3 is a block diagram showing components of an ink jet printer according to an embodiment of the present invention.

As shown in FIG. 3, the ink jet printer 1 includes a microcomputer 11 and a gate array 22 connected together by bus lines 23, 24 and an ejection timing signal line TS. The microcomputer 11 serves as the main controller of the ink jet printer 1 and is connected to an operation panel 14, a carriage motor driver 15, a line feed motor driver 16, a paper sensor 17, a carriage sensor 18, and an ink tank sensor 19. The carriage motor driver 15 is for driving a carriage motor 54 to rotate. Rotation of the carriage motor 54 reciprocally moves a carriage, on which a print head unit 40 (to be described later) is mounted, in a main scanning direction. The line feed motor driver 16 is for driving a line feed motor 43 to rotate. Rotation of the line feed motor 43 rotates a platen, for example, to supply sheets in front of print heads 30, 31 of the print head unit 40 in an auxiliary direction, which is perpendicular to the main scanning direction. The operation panel 14 is used by an operator to input various commands to the microcomputer 11. The carriage sensor 18 detects when the carriage is in its initial position. The ink tank sensor 19 detects whether an ink tank (not shown) is detached from or attached to the carriage. The microcomputer 11 is also connected to a random access memory (RAM) 13 and a read only memory (ROM) through the bus lines 23, 24. The RAM 13 is for temporarily storing a variety of data and the ROM 12 is for storing print control programs and the like.

The gate array 11 is for processing print data and is connected to an interface 27, an image memory 25, and a drive circuit 21. The interface 27 is connected to the printer port of a personal computer 26. The image memory 25 stores print data received over the interface 27. The gate array 22 is connected to the drive circuit 21 through signal lines 28*a* to 28*d*. The drive circuit 21 is capable of selectively applying voltage to piezoelectric elements 32 of the print heads 30, 31 of the print head unit 40. The signal line 28*a* transmits data signals from the gate array 22 to the drive circuit 21. The signal line 28*b* transmits a clock for synchronizing transmission of data transmitted over the signal line 28*a*. The signal line 28*c* is for transmitting a strobe signal. The signal lines 28*d* transmit waveform data signals, which include a plurality of waveforms to be described later with reference to FIG. 8. The drive circuit 21 is connected to the head drive power source 29 and the two print heads 30, 31. The gate array 22 is also connected to a head drive power source 29 through a line 28*e* for transmitting control signals from the gate array 22 to the head drive power source 29.

Figure 4:
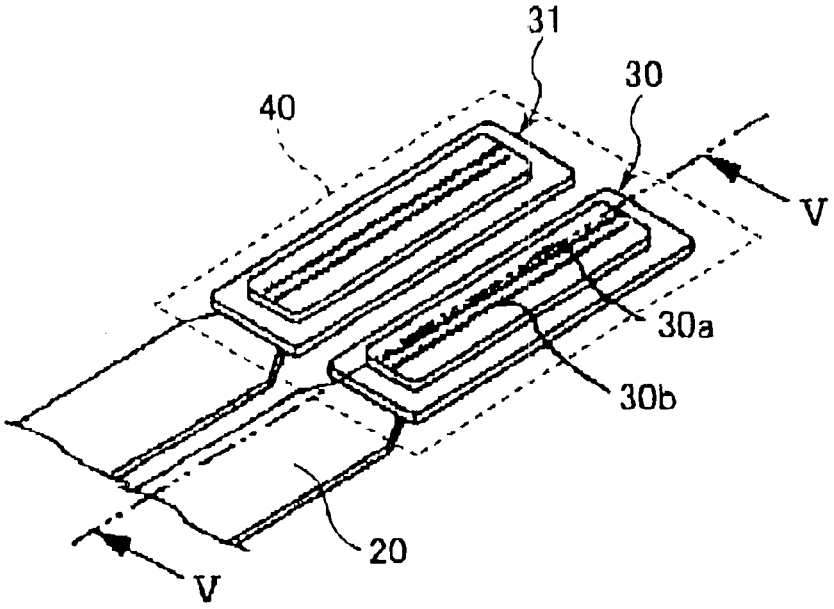
FIG. 4 is a perspective view showing a print head unit of the printer of FIG. 3.

As shown in FIG. 4, each of the print heads 30, 31 of the print head unit 40 is formed with two rows 30*a*, 30*b* of ejection nozzles. The print heads 30, 31 are supported on the carriage with the nozzle rows facing downward, that is, in the inverted orientation of that shown in FIG. 4. A flexible cable 20 is connected to the print heads 30, 31. The drive circuit 21 is mounted on the flexible cable 20.

Figure 5:
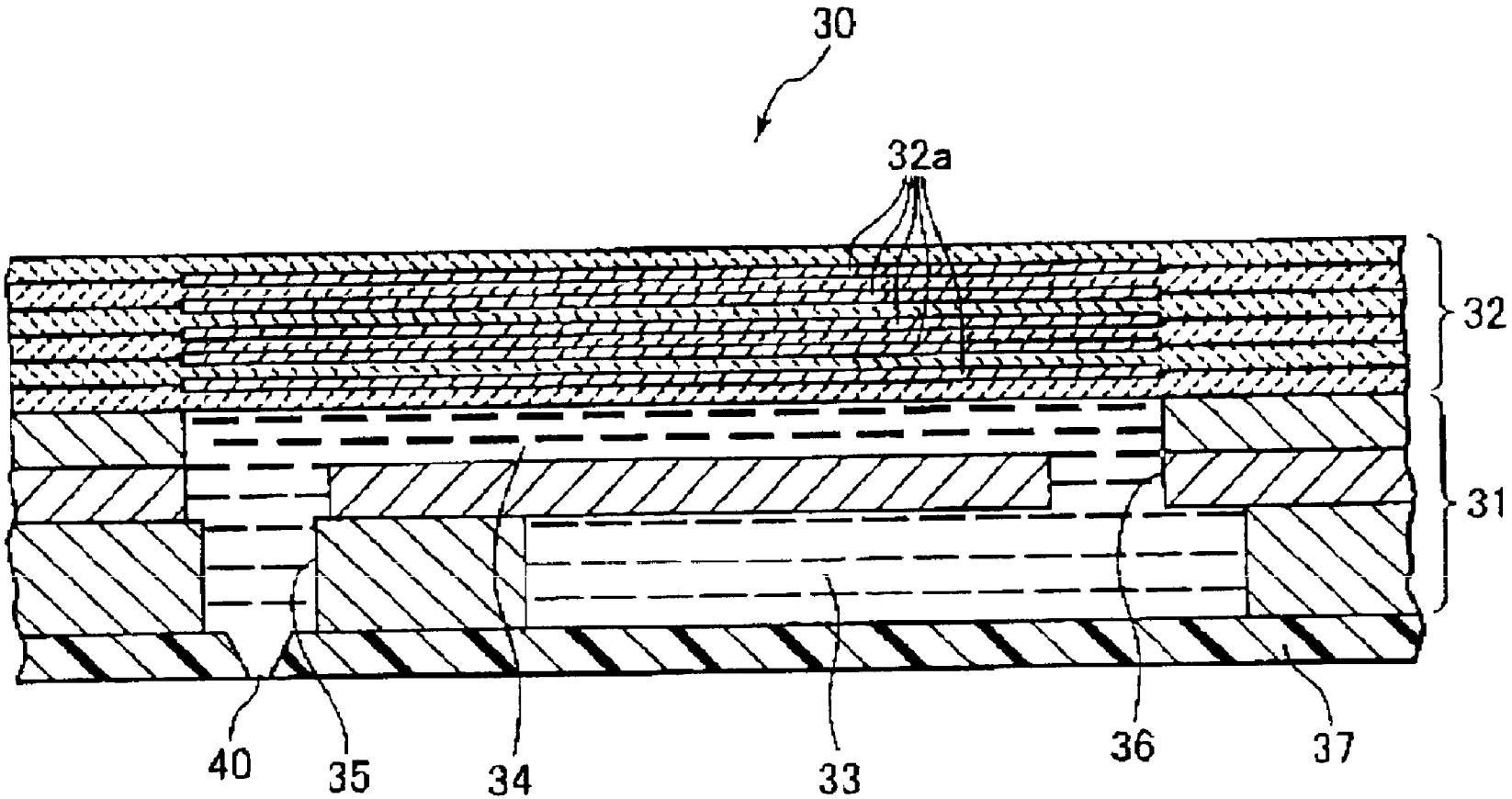
FIG. 5 is a cross-sectional view taken along line V—V of FIG. 4.

Next, internal configuration of the print heads 30, 31 will be described while referring to FIG. 5. Each of the print heads 30, 31 has the same internal configuration, so configuration of both of the print heads 30, 31 will be described using the print head 30 as a representative example. As shown in FIG. 5, the print head 30 includes a cavity plate 31, a piezoelectric element 32, and a nozzle plate 37. The cavity plate 3 is configured from a stack of stainless steel plates. The piezoelectric element 32 is formed from a stack of piezoelectric layers and is mounted on the cavity plate 31.

The nozzle plate 37 is formed with the nozzle rows 30*a*, 30*b*, although only a representative nozzle 40 from the nozzle row 30*a* is shown in FIG. 5. Internal configuration of the print heads 30, 31 is the same for each nozzle in the nozzle rows 30*a*, 30*b*, so configuration relating to only the representative nozzle 40 of row 30*a* will be described while referring to FIG. 5. The Cavity plate 31 is formed with a manifold 33, a pressure chamber 34, and connecting through holes 35, 36. The connecting through hole 36 brings the manifold 33 into fluid communication with the pressure chamber 34, and the connecting through hole 35 brings the pressure chamber 34 into fluid communication with the corresponding nozzle 40. Electrodes 32*a* are interposed between the piezoelectric layers at positions corresponding to the pressure chambers 34. The center piezoelectric layers are each sandwiched between two of the electrodes 32*a*.

When voltage is applied in a drive waveform to a set of electrodes 32*a*, the corresponding portion of the piezoelectric element 32 deforms into the corresponding pressure chamber 34. This increases the pressure in the pressure chamber 34 so that ink filling the pressure chamber 34 is pushed through the through hole 35 and ejected from the corresponding nozzle 40.

Figure 6:
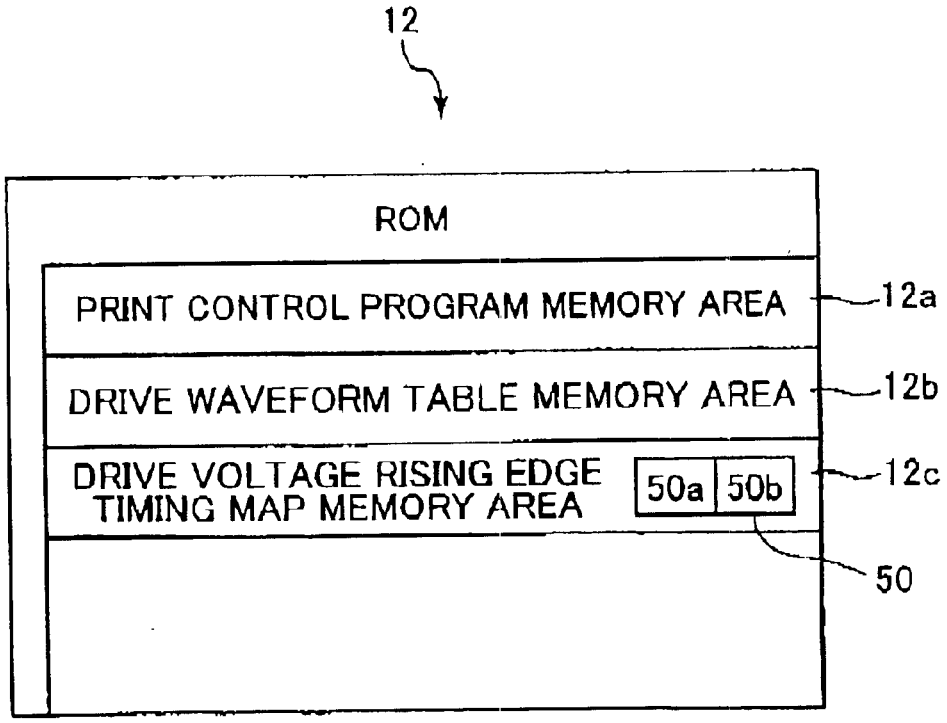
FIG. 6 is a schematic view representing memory areas of a ROM of the ink jet printer of FIG. 3.

Next, memory areas in the ROM 12 will be described with reference to FIG. 6. As shown in FIG. 6, the ROM 12 includes a print control program memory area 12*a*, a drive waveform table memory area 12*b*, and a drive voltage rising edge timing map memory area 12*c*. The print control program memory area 12*a* stores print control programs for controlling printing operations of the ink jet printer 1. The drive waveform table memory area 12*b* stores drive waveforms 0-0, 1-0, 0-1, 1-1, 0-2, 1-2, 0-3, 1-3, 0-4, 1-4, 0-5, and 1-5 shown in FIG. 8. The drive voltage rising edge timing map memory area 12*c* stores rising edges of all waveforms used to apply drive voltage to the print heads 30, 31 as a drive voltage rising edge timing map 50 shown in FIG. 8. The drive voltage rising edge timing map memory area 12*c* stores the same timing map for both of the print heads 30, 31 as timing maps 50*a*, 50*b*.

Figure 7:
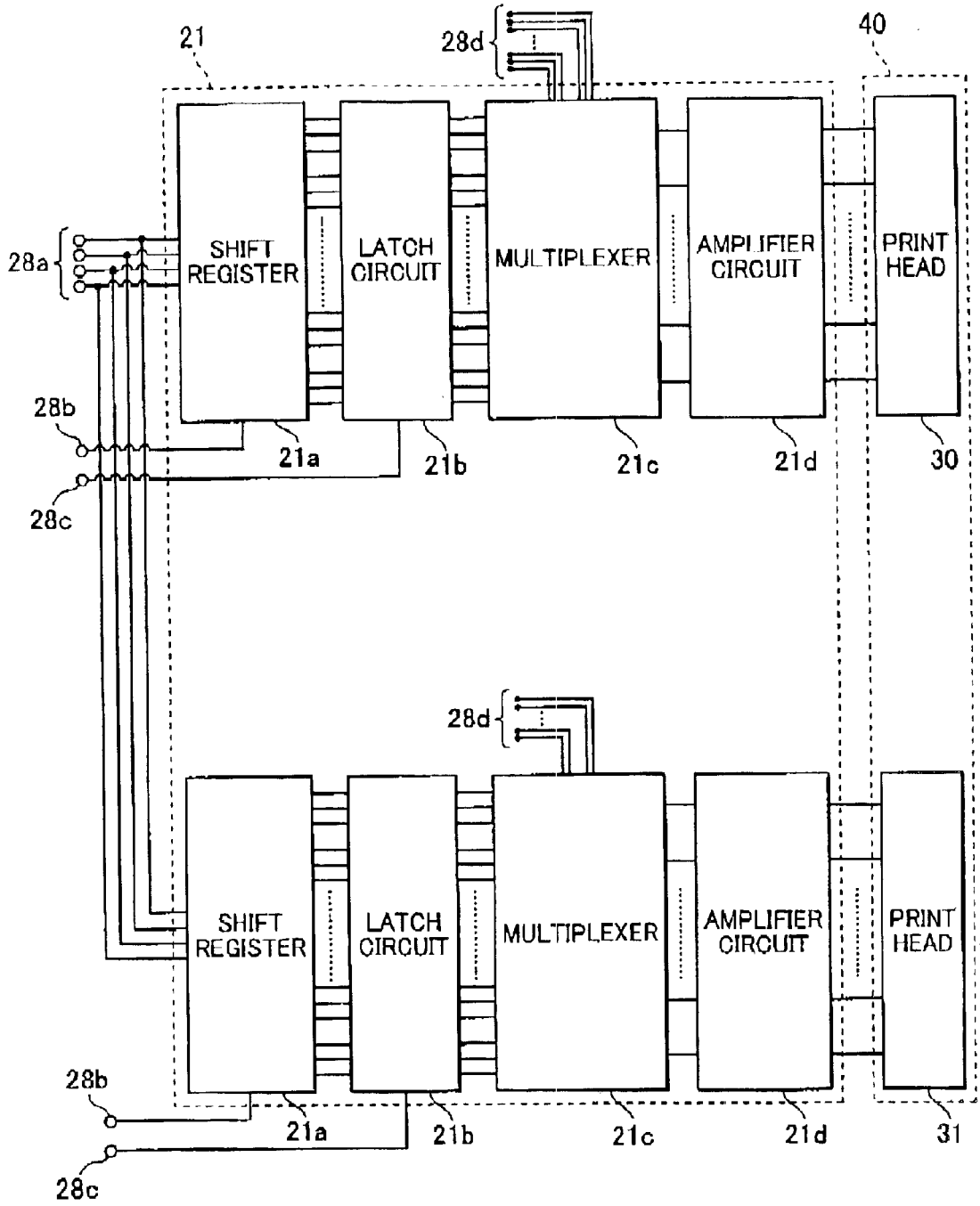
FIG. 7 is a block diagram representing configuration of a drive circuit of the ink jet printer of FIG. 3.

Next, the configuration of the drive circuit 21 will be described with reference to FIG. 7. The drive circuit 21 includes substantially the same components separately for each of the print heads 30, 31 of the print head unit 40. Therefore, the configuration of the drive circuit 21 that relates to only the print head 30 will be described here as a representative example. The drive circuit 21 includes a shift register 21*a*, a latch circuit 21*b*, a drive waveform selection circuit (multiplexer) 21*c*, and an amplifier circuit 21*d*. The shift register 21*a* receives print data serially transmitted over the signal lines 28*a* at timing determined by the transmission synchronization clock signal from the signal line 28*b* and converts the serial print data into parallel data that corresponds to the ejection nozzles of the print heads. The latch circuit 21*b* receives the parallel data from the shift register 21*a* and outputs it based on the strobe signal from the signal line 28*c*. The drive waveform selection circuit (multiplexer) 21*c* receives the waveform data signals over the signal lines 28*d* and the data from the latch circuit 21*b*. The waveform signals include all of the drive waveforms 0-0, 1-0, 0-1, 1-1, 0-2, 1-2, 0-3, 1-3, 0-4, 1-4, 0-5, and 1-5 stored in the drive waveform table memory area 12*b* of the ROM 12. The data from the latch circuit 21*b* includes gradation data that serves as waveform data. Therefore, based on the gradation data, the drive waveform selection circuit (multiplexer) 21*c* selects an appropriate single waveform from the plurality of drive waveforms received over the signal lines 28*d* and outputs the selected waveform to the amplifier circuit 21*d*. The amplifier circuit 21*d* amplifies the selected waveform and outputs it to the print heads 30, 31.

Figure 8:
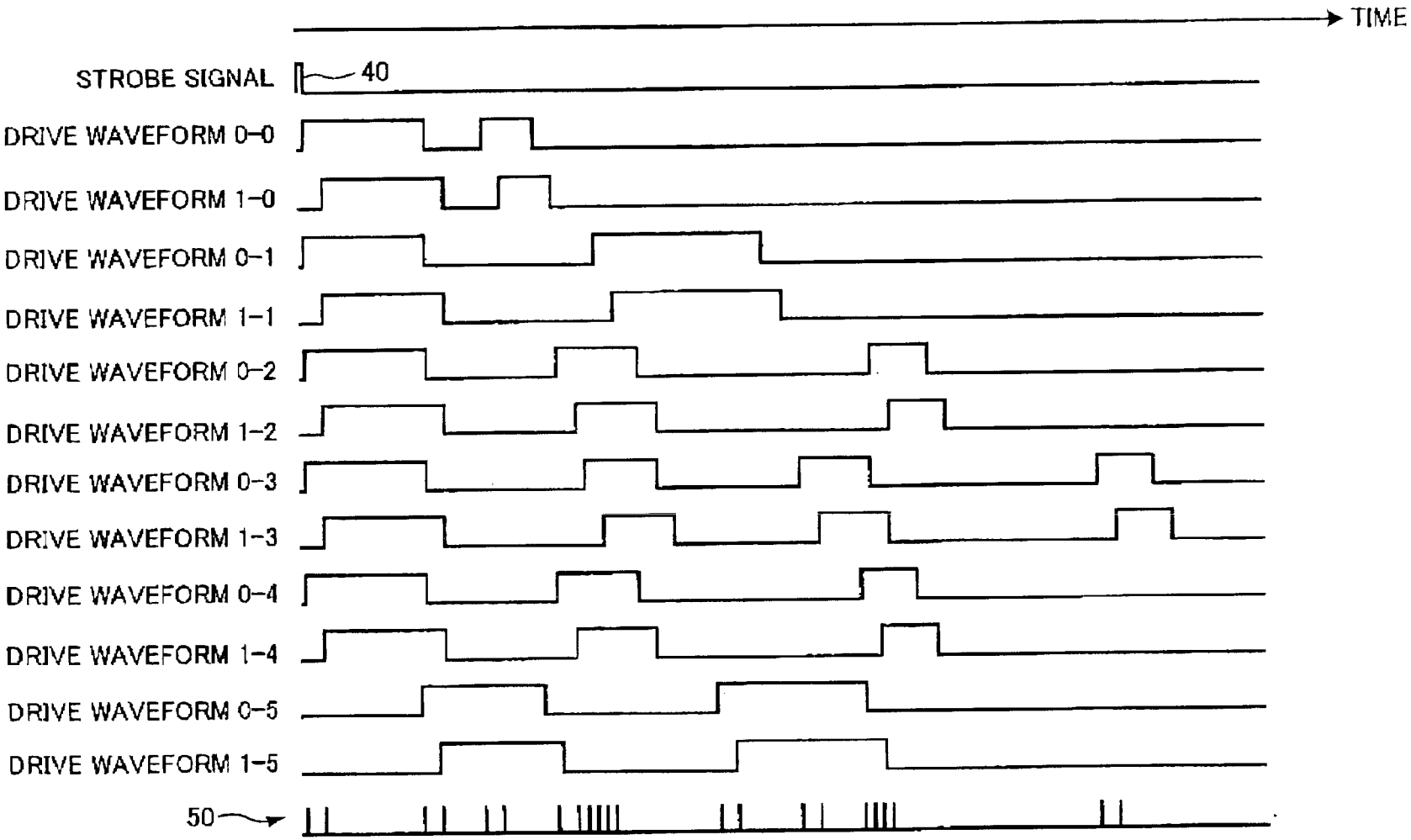
FIG. 8 is a timing chart showing relationships between timing of a strobe signal, a variety of drive waveforms stored in the ROM of FIG. 6, and a drive voltage rising edge timing map stored in the ROM of FIG. 6.
Figure 9:
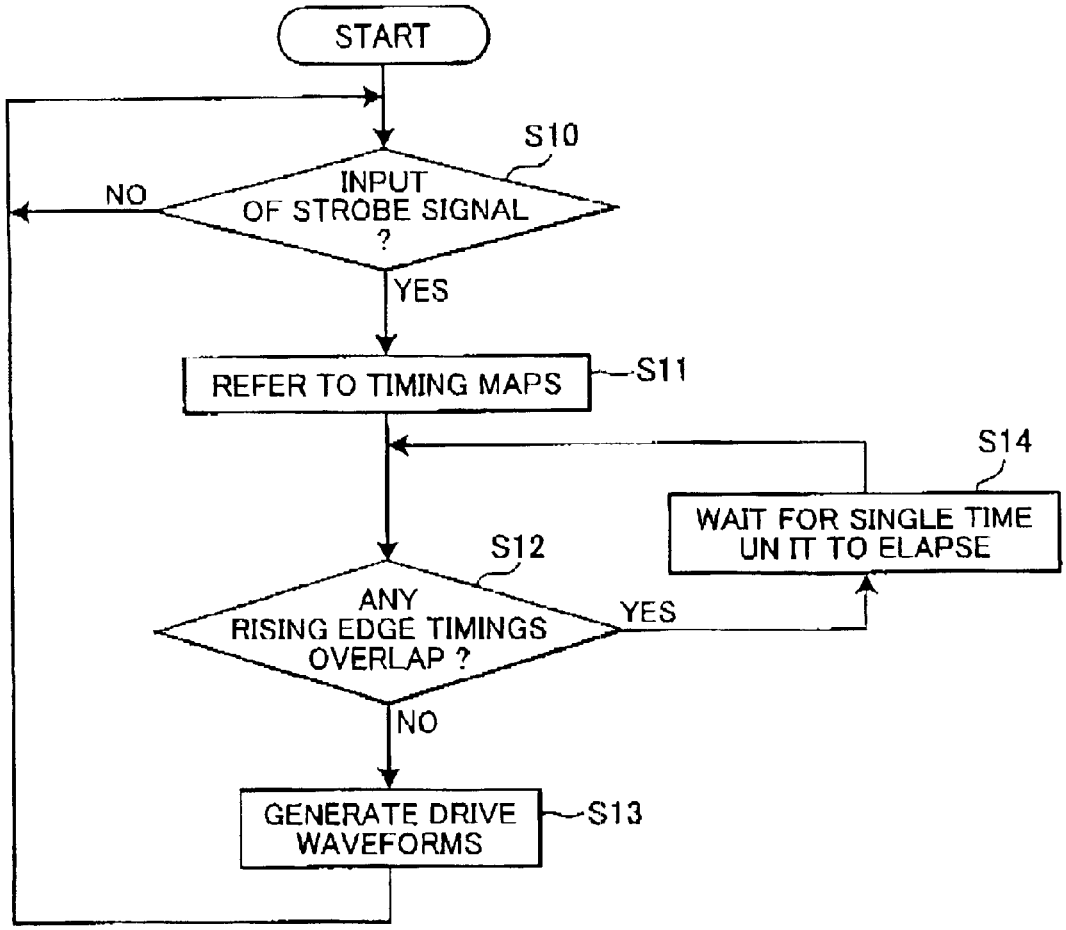
FIG. 9 is a flowchart representing processes relating to generation of drive waveforms.

Next, the drive voltage rising edge timing map 50 stored in the drive voltage rising edge timing map memory area 12*c* of the ROM 12 will be explained. FIG. 8 is a timing chart showing relationship between strobe signal 40 from the signal line 28*e*, the drive waveforms used to apply voltage to the electrodes 32*a* of the piezoelectric elements 32, and the drive voltage rising edge timing map 50. As described previously, the drive waveform table memory area 12*b* of the ROM 12 stores drive waveforms 0-0, 1-0, 0-1, 1-1, 0-2, 1-2, 0-3, 1-3, 0-4, 1-4, 0-5, and 1-5. Each of the drive waveforms includes a plurality of voltage "pulses." The pulses each includes a rising edge and a lowering edge and are timed to eject a plurality ink droplets in succession to form a single dot, to cancel out pressure waves that can remain in the ink chambers 34, the manifold 33, and the like after an ink ejection, or to perform some similar well known function. The rising edges and lowering edges of each waveform are timed as indicated by their positioning in FIG. 8. Based on the content of the print data that was outputted from the latch circuit 21*b* in response to strobe signal 40 from the signal line 28*c*, the multiplexer 21*c* selects one of the waveforms from the signal lines 28*d* and outputs it to the print heads 30, 31 via the amplifier circuit 21*d*. The selected waveform is then used to eject ink droplets for one ink ejection operation of the print heads 30, 31.

The drive voltage rising edge timing map 50 indicates the timing of each rising edge of all the pulses in all of the waveforms stored in the drive waveform table memory area 12*b*. The rising edge of the voltage pulses is the time when current flow is at a maximum in the pulse. The representation of drive voltage rising edge timing map 50 in FIG. 8 shows the different rising edges each indicated as a vertical black line. As mentioned above, the drive voltage rising edge timing map memory area 12*c* stores the same timing map for both of the print heads 30, 31 as timing maps 50*a*, 50*b* because the drive circuit 21 outputs the same waveform to the multiplexers 21*c*, 21*c* of both print heads 30, 31.

The microcomputer 11 performs control operations to prevent the rising edges of drive voltage pulses applied to the different heads from overlapping. These control operations of the microcomputer 11 will be explained using the representation of the drive voltage rising edge timing map 50 shown in FIG. 8, the flowchart of FIG. 9, and the schematic diagram of FIG. 10. In the present embodiment, the microcomputer 11 is preset to drive the second print head 31 after an optional delay time t from drive of the first print head 30.

Figure 10:
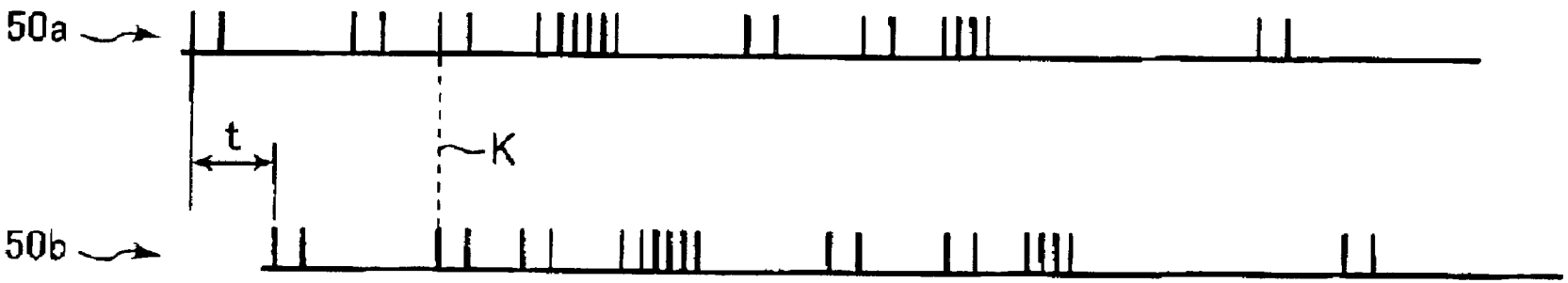
FIG. 10 is a timing chart showing drive voltage rising edge timing maps for two different heads being compared.

First, the microcomputer 11 judges whether the strobe signal is input to the drive circuit 21 for the second print head 31 (S10). In other words, the microcomputer 11 judges whether voltage is to be applied to piezoelectric elements 32 of the second print head 31 of the print head unit 40 in order to perform a print operation using that section of the print head unit 40, that is, the second print head 31. When the strobe signal is input to the drive circuit 21 for the second print head 31 (S10:YES), then the microcomputer 11 refers to the timing maps 50*a*, 50*b* for the first and second print heads 30, 31 (S11). In this step, as shown in FIG. 10 the microcomputer 11 shifts the temporal position of the timing map 50*b* from the timing map 50*b* by the optional delay time t. Then, the microcomputer 11 determines whether positions of any of the vertical black lines in the timing map 50*a* are aligned with the vertical black lines of the timing map 50*b* (S12). In other words, the microcomputer 11 determines whether there is a possibility that any voltage application timing scheduled for the second print head 31 will occur at the same time as a voltage application timing for the first print head 30, even though ejection timings for the second print head 31 are intentionally delayed by the optional delay time t from ejection timings of the first print head 30. If none of the rising edges of drive voltages for the different print heads 30, 31 overlap (S12:NO), then the microcomputer 11 outputs the drive waveform signal including all of the waveforms from the drive waveform table memory area 12*b* of the ROM 12 (S13) to the multiplexer 21*c*, which selects one of the drive waveforms to drive the second print head 31 based on the gradation data from the latch circuit 21*b*.

On the other hand, if any of the rising edges of the drive voltages for the different heads 30, 31 overlap (S12:YES), then the microcomputer 11 waits for a predetermined unit of time (S14). In the example shown in FIG. 10, even though the print heads 30, 31 are driven at timings that are shifted beforehand by the optional time duration t, the rising edge timings in the maps 50*a* and 50*b* overlap at timing K. Therefore, the microcomputer 11 waits for the predetermined time of 0.125 microseconds (S14) and again searches for overlapping rising edges (S12). Once there are no overlapping rising edges (S12:YES), then the microcomputer 11 outputs the drive waveform signal (S13) to drive the print head 31.

With this configuration, generation of the drive waveforms can be controlled so that the rising edges of drive voltages, that is, the current flow peaks, do not overlap, even in cases when print heads are driven at timings that are shifted beforehand by an optional time duration. Because the print head drive unit shifts the current peaks, an overall drop in drive voltage can be prevented. Therefore, the adverse effects on ink ejection characteristics caused by such drop in drive voltage can be prevented.

While the invention has been described in detail with reference to specific embodiments thereof, it would be apparent to those skilled in the art that various changes and modifications may be made therein without departing from the spirit of the invention, the scope of which is defined by the attached claims.

For example, the embodiment describes using piezoelectric elements as the actuators of the print heads 30, 31. However, any type of actuator can be used to generate energy upon application of voltage to eject ink droplets.

The embodiment describes each timing map as including the rising edges of all of the different drive waveforms. However, a separate timing map could be prepared for each waveform, wherein each timing map indicates only the rising edge timings of the corresponding waveform. In this case, the microcomputer 11 can select the drive waveform that will actually be applied to the print heads based on the gradation data included in the data that the microcomputer 11 will send to the multiplexer 21*c* via the gate array 22. The microcomputer 11 then compares only the timing maps that correspond to the selected drive waveform.

Also, the embodiment describes providing a separate latch circuit for each print head. However, two or more latch circuits could be provided for each print head, with each latch circuit being responsible for a certain section of the corresponding print head. In this case, the timing at which the rising edge of the waveform will be applied to the different sections of the print head can be compared and, if they overlap, shifted out temporal alignment.

The embodiment describes a print head unit with two heads serving as independently driven sections of the print head unit. However, the print head unit could only be provided with a single print head wherein two or more different sections of the print head are driven independently. In this case, latch circuits can be provided for the different sections of the print head as described above. Alternatively, the print head unit can be provided with more than two heads serving as independently driven sections of the print head unit. In this case, different sections of each head can be independently driven, for example, by providing more than one latch circuit for each print head.

Further, the embodiment describes shifting the entire waveform if any overlapping rising edges are discovered. However, only the timing of an overlapping rising edge and afterward need be shifted. The timing before the overlapping rising edge can remain the same.

Also, the embodiment uses the timing maps 50*a*, 50*b* shown in FIG. 10 as examples of timing maps that indicate high current times of waveforms. However, any timing map that enables the microcomputer to know the temporal relationship of high current times can be used instead.

Also, the embodiment describes using the strobe signal to judge when a print operation is to be performed by one section of the print head unit. However, the present invention is not limited to use of the strobe signal to make this judgment.

The embodiment describes supplying the same waveforms to all sections of the print head unit. However, different waveforms can be supplied to different sections of the print head unit. In this case, each timing map can be prepared to indicate rising edges of waveforms supplied to the corresponding section of the print head unit.

What is claimed is:

1. A drive unit for driving a print head unit including a plurality of actuators, the drive unit comprising:

a drive circuit that selectively applies drive waveforms of a plurality of drive waveforms to the actuators of the print head unit to drive the actuators;

a memory prestored with a high current time for each of the plurality of drive waveforms, each high current time representing a time of high current flow resulting from the drive circuit applying the corresponding drive waveform to the actuators; and a drive circuit control unit that, based on the high current times stored in the memory, controls the drive circuit to apply drive waveforms to different sections of the print head unit at timings with no overlap in high current times of the drive waveforms applied to the different sections.

2. A drive unit as claimed in claim 1, wherein the drive circuit control unit compares a high current time of a drive waveform for one section of the print head unit with a high current time of a drive waveform for another section of the print head unit and delays timing at which the drive circuit applies the drive waveform to the one section until the corresponding high current time will not overlap with the high current time of drive waveform for the other section.

3. A drive unit as claimed in claim 2, wherein the memory stores separate sets of high current times for the one section and the other section of the print head unit, the drive circuit control unit comparing all high current times stored in the memory for the one section of the print head unit with all high current times stored in the memory for the other section of the print head unit and delaying timing at which the drive circuit applies the drive waveform to the one section until none of the high current times for the one section overlaps any of the high current times for the other section.

4. A drive unit as claimed in claim 3, wherein the memory stores the same high current times separately for each of the one section and the other section of the print head unit.

5. A drive unit as claimed in claim 1, wherein the high current times stored in the memory are timings of rising edges of drive voltage pulses in the drive waveforms outputted by the drive waveforms output circuit.

6. A drive unit as claimed in claim 1, wherein the drive circuit independently applies drive waveforms to the actuators of different sections of each print head of the print head unit.

7. A drive unit as claimed in claim 1, wherein the drive circuit independently applies drive waveforms to the actuators of different print heads as sections of the print head unit.

8. A drive unit as claimed in claim 1, further comprising a drive waveform output circuit that stores and outputs the plurality of drive waveforms to the drive circuit.

9. A drive unit for independently driving at least two different sections of a print head unit, the drive unit comprising:

a memory that stores timing maps indicating rising edges of drive waveforms used to drive the print head unit;

a print timing judge unit that judges when one of the sections of the print head unit is to be driven to perform a print operation;

a comparator that, when the print timing judge unit judges that the one section is to be driven, compares the timing maps in the memory to find rising edges that overlap between a timing map that corresponds to a drive waveform used to drive the one section and a timing map that corresponds to a drive waveform used to drive another section of the print head unit; and a print operation delay unit that, when the comparator finds rising edges that overlap, delays drive of the one section until the comparator no longer finds rising edges that overlap after the comparator shifts, according to the delay, the timing map that corresponds to the drive waveform used to drive the one section.

10. A drive unit as claimed in claim 9, wherein the comparator automatically, before comparing the timing maps, shifts the timing map that corresponds to the drive waveform used to drive the one section by an optional delay time from the timing map that corresponds to a drive waveform used to drive another section of the print head unit.

11. A drive unit as claimed in claim 9, wherein the memory stores a timing map for each section of the print head, each timing map indicating all rising edges of drive waveforms used to drive the corresponding section of the print head unit.

12. A drive unit as claimed in claim 11, wherein the comparator shifts the entire timing map based on the delay.

13. A drive unit as claimed in claim 11, wherein the comparator shifts a portion of the timing map that corresponds to after a timing when rising edges overlap.

14. A drive unit as claimed in claim 9, wherein the memory stores a timing map for each drive waveform used to drive the print head unit.

15. A drive unit as claimed in claim 9, wherein the drive circuit independently applies drive waveforms to the actuators of different sections of each print head of the print head unit.

16. A drive unit as claimed in claim 9, wherein the drive circuit independently applies drive waveforms to the actuators of different print heads as sections of the print head unit.

17. A method of independently driving at least two different sections of a print head unit, the method comprising:

judging when one of the sections of the print head unit is to be driven to perform a print operation;

comparing, when the one section is to be driven, timing maps that indicate rising edges of drive waveforms used for driving the print head unit; and delaying, when rising edges are found to overlap between a timing map that corresponds to a drive waveform used to drive the one section and a timing map that corresponds to a drive waveform used to drive another section of the print head unit, drive of the one section while shifting, according to the delay, the timing map that corresponds to the drive waveform used to drive the one section until no rising edges are found to overlap.

18. A method as claimed in claim 17, wherein the step of comparing includes automatically, before comparing the timing maps, shifting the timing map that corresponds to the drive waveform used to drive the one section by an optional delay time from the timing map that corresponds to a drive waveform used to drive another section of the print head unit.

* * * * *